US007293729B2

(12) United States Patent
Ragnarsson

(10) Patent No.: US 7,293,729 B2
(45) **Date of Patent: *Nov. 13, 2007**

(54) ARRANGEMENT FACILITATING SINGLE FASTENER ATTACHMENT FOR STRIKERS OF A WOOD COMMINUTING ROTOR

(75) Inventor: Anders Ragnarsson, Chester, NH (US)

(73) Assignee: Continental Biomass Industries, Inc., Newtown, NH (US)

( * ) Notice: Subject to any disclaimer, the term of this patent is extended or adjusted under 35 U.S.C. 154(b) by 16 days.

This patent is subject to a terminal disclaimer.

(21) Appl. No.: 10/360,950

(22) Filed: Feb. 6, 2003

(65) Prior Publication Data

US 2003/0116665 A1 Jun. 26, 2003

Related U.S. Application Data

(63) Continuation-in-part of application No. 09/885,653, filed on Jun. 20, 2001, now Pat. No. 6,655,931, which is a continuation-in-part of application No. 09/635,320, filed on Aug. 9, 2000, now Pat. No. 6,394,378.

(51) Int. Cl.
*B02C 13/28* (2006.01)
*B02C 13/26* (2006.01)

(52) U.S. Cl. ..... 241/197; 241/191; 241/195; 241/291; 241/294; 241/295; 241/300; 15/126

(58) Field of Classification Search ..... 241/291, 241/294, 295, 191, 195, 197, 300; D15/126
See application file for complete search history.

(56) References Cited

U.S. PATENT DOCUMENTS

| | | | | |
|---|---|---|---|---|
| 4,871,119 | A * | 10/1989 | Murata et al. | 241/189.1 |
| 5,165,611 | A | 11/1992 | Ragnarsson | |
| 6,045,072 | A | 4/2000 | Zehr | |
| 6,131,838 | A * | 10/2000 | Balvanz et al. | 241/195 |
| 6,394,378 | B1 | 5/2002 | Ragnarsson | |
| 6,422,495 | B1 * | 7/2002 | De Boef et al. | 241/197 |
| 6,481,655 | B1 * | 11/2002 | Feigel, Jr. | 241/294 |
| 2001/0040198 | A1 * | 11/2001 | Rossler | 241/294 |

* cited by examiner

*Primary Examiner*—Derris H. Banks
*Assistant Examiner*—Jason Y. Pahng
(74) *Attorney, Agent, or Firm*—Davis Bujold & Daniels, P.L.L.C.

(57) ABSTRACT

A comminuting striker assembly for mounting on a rotor of a comminuting apparatus comprising: a striker having first and second opposed faces, the first face defining at least one cutting edge, and a striker retainer, the striker and striker retainer defining cooperating primary support surfaces and cooperating alignment components.

23 Claims, 10 Drawing Sheets

ARRANGEMENT FACILITATING SINGLE FASTENER ATTACHMENT FOR STRIKERS OF A WOOD COMMINUTING ROTOR

RELATED APPLICATION

This is a continuation-in-part of and claims benefit of patent application Ser. No. 09/885,653 filed Jun. 20, 2001, now U.S. Pat. No. 6,655,931, which is a continuation-in-part of and claims benefit of patent application Ser. No. 09/635,320 filed Aug. 9, 2000, now U.S. Pat. No. 6,394,378.

FIELD OF THE INVENTION

The invention provides an improved striker attachment for wood comminuting rotors which facilitates a keyed attachment enabling both a single fastener to be utilized attaching the striker to the striker retainer, and rapid removal and replacement of the striker.

BACKGROUND OF THE INVENTION

Prior art comminuting apparatus for reducing large diameter wood products and stumps to a desired size, have comprised a reduction chamber, with an impact rotor positioned concentrically therein, in combination with a housing, drive motor and infeed chute. The impact rotor is formed with a plurality of horizontally elongate impact strikers at its periphery. The rotor is positioned so that the elongate wood product or stump falling under the influence of gravity through the infeed chute is directed against the strikers, and repelled ahead of the rotor's rotational direction against an anvil formed along one side of the reduction chamber.

Prior art wood comminuting apparatus are often capable of comminuting trees or parts thereof up to 40 inches in diameter (see e.g. U.S. Pat. No. 5,165,611). Strikers used for the comminution are bolted directly to mounting projections on the rotor which is rotated to produce the comminution. Maintenance to change strikers has required complete removal of the striker mounting bolts with the consequent potential loss of bolts and uneconomical use of maintenance time, especially in view of the substantial number of strikers on a rotor of such apparatus. Strikers of the prior art are typically fastened with two (2) hex head or similar studs, stud-bolts or bolts, relying on fastener torque to position and retain the strikers, resulting in the above noted potential loss of bolts and uneconomical use of maintenance time.

SUMMARY OF THE INVENTION

It is an object of the invention to improve maintenance time and ease of striker replacement in comminution apparatus minimizing the potential for loss of components including fasteners.

It is a further object of the invention to improve the support and alignment of the strikers for initial installation of the strikers, during operation of the comminuting device, and during maintenance or replacement of strikers.

According to the invention there is provided a comminuting striker assembly for mounting on a rotor of a comminuting apparatus, the comminuting striker assembly comprising:

a striker having first and second opposed faces with the first face defining at least one cutting edge, and the second face of the striker having a cooperating surface; and a striker retainer having a retainer base for attachment to a rotor and a leading face for attachment to the striker, the leading face having a striker support surface for engaging with the cooperating surface of the striker to provide primary support for the striker; wherein the second face of the striker defines an alignment component while the leading face of the striker retainer defines a complimentary alignment component arrange to mate with the alignment component of the striker and to facilitate desired alignment of the striker with the striker retainer.

Also according to the invention there is provided a comminuting striker assembly for mounting on a rotor of a comminuting apparatus, the comminuting striker assembly comprising:

a striker having first and second opposed faces with the first face defining at least one cutting edge, and the second face of the striker having a cooperating surface; and a striker retainer having a retainer base for attachment to a rotor and a leading face for attachment to the striker, the leading face having a striker support surface for engaging with the cooperating surface of the striker to provide primary support for the striker; wherein one of the second face of the striker and the leading face of the striker retainer defines a first slot and the other of the second face and the leading face defines a complimentary first key arrange to engage the first slot thereby to facilitate proper alignment of the striker with the striker retainer, with the first slot and first key extending perpendicular to the cooperating surface and the striker support surface.

When the first key and the first slot are engaged, a single bore extends through the striker retainer from the leading face to a following face of the striker retainer; and a threaded fastener extends through the single bore in the striker retainer to the striker from the following face to attach the striker to the striker retainer by the use of a corresponding threaded bore in the striker. Preferably the corresponding threaded bore of the striker is a blind bore which opens to the second face of the striker but does not extend through the striker to the first face of the striker. In addition, according to the invention, one of the second face of the striker and the leading face of the striker retainer defines a second slot extending perpendicular to the first slot and the other of the second face and the leading face defines a complimentary second key arranged to engage the second slot thereby additionally to facilitate proper alignment of the striker with the striker retainer.

According to the invention there is also provided a method of mounting a comminuting striker assembly on a rotor of a comminuting apparatus, the method comprising the steps of:

providing a striker with first and second opposed faces with the first face defining at least one cutting edge, and forming a cooperating surface in the second face of the striker; and providing a striker retainer with a retainer base for attachment of the comminuting striker assembly to a rotor and with a leading face for attachment of the striker to the striker retainer, forming the leading face with a striker support surface for engaging with the cooperating surface of the striker to provide primary support for the striker; and the second face defining an alignment component;

leading face defining a complimentary alignment component arrange to mate with the alignment component of the striker to facilitate desired alignment of the striker with the striker retainer.

Also according to the invention there is provided a method of mounting a comminuting striker assembly on a rotor of a comminuting apparatus, the method comprising the steps of:

providing a striker with first and second opposed faces with the first face defining at least one cutting edge, and forming a cooperating surface in the second face of the striker; and providing a striker retainer with a retainer base for attachment of the comminuting striker assembly to a rotor and with a leading face for attachment of the striker to the striker retainer, forming the leading face with a striker support surface for engaging with the cooperating surface of the striker to provide primary support for the striker; further comprising the steps of:

defining a first slot in one of the second face of the striker and the leading face of the striker retainer and defining a complimentary first key on the other of the leading face of the striker retainer and the second face of the striker arrange to engage the first slot to facilitate desired alignment of the striker with the striker retainer; the first slot and the first key extending perpendicular to the cooperating surface and the striker support surface.

In addition according to the invention, preferably a single bore is extended through the striker retainer from the leading face to a following face thereof;

a corresponding threaded bore is formed into the striker from the second face of the striker;

a threaded fastener is provided; and the threaded fastener is passed through the single bore of the striker retainer from the following face of the striker retainer to the striker to attach the striker to the striker retainer by the use of a corresponding threaded bore in the striker. Also preferably the corresponding threaded bore in the striker is formed as a blind bore opening to the second face of the striker which does not extend through the striker to the first face of the striker.

BRIEF DESCRIPTION OF THE DRAWINGS

The invention will now be described, by way of example, with reference to the accompanying drawings, in which.

DETAILED DESCRIPTION OF THE EMBODIMENTS

Figure 1:
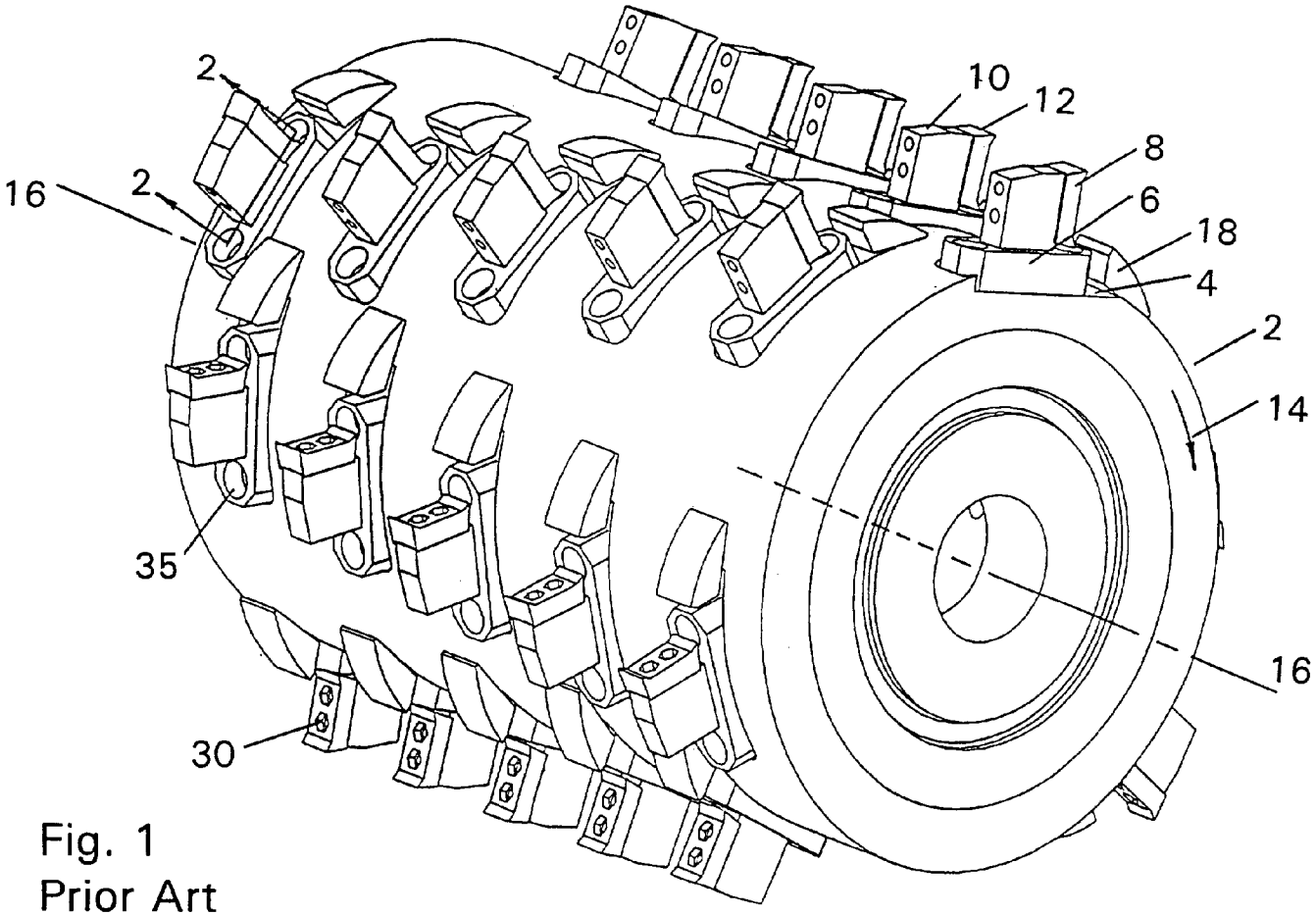
Fig. 1 Prior Art
FIG. 1 is an orthogonal view of a rotor with a plurality of strikers and retainers mounted thereto, showing two types of strikers.

Referring to FIG. 1, a prior art assembly of rotor 2 of a wood comminutor defines striker carrying faces 4 for supporting a retainer bases 6 which supports strikers 8 by way of striker retainers 10 against comminuting forces during comminution with the face 4 and cutting edge 12 of the striker 8 facing in the direction of rotor rotation 14 about rotor axis 16. Projections 18 on the rotor 2, one for each striker 8, direct a work piece (not shown) into the cutting edge 12 of each striker 8 and away from striking the work piece facing side of retainer base 6. The configuration of strikers, striker retainers, and projections shown herein are based on prior art designs, and are therefore not discussed in detail herein.

Figure 2:
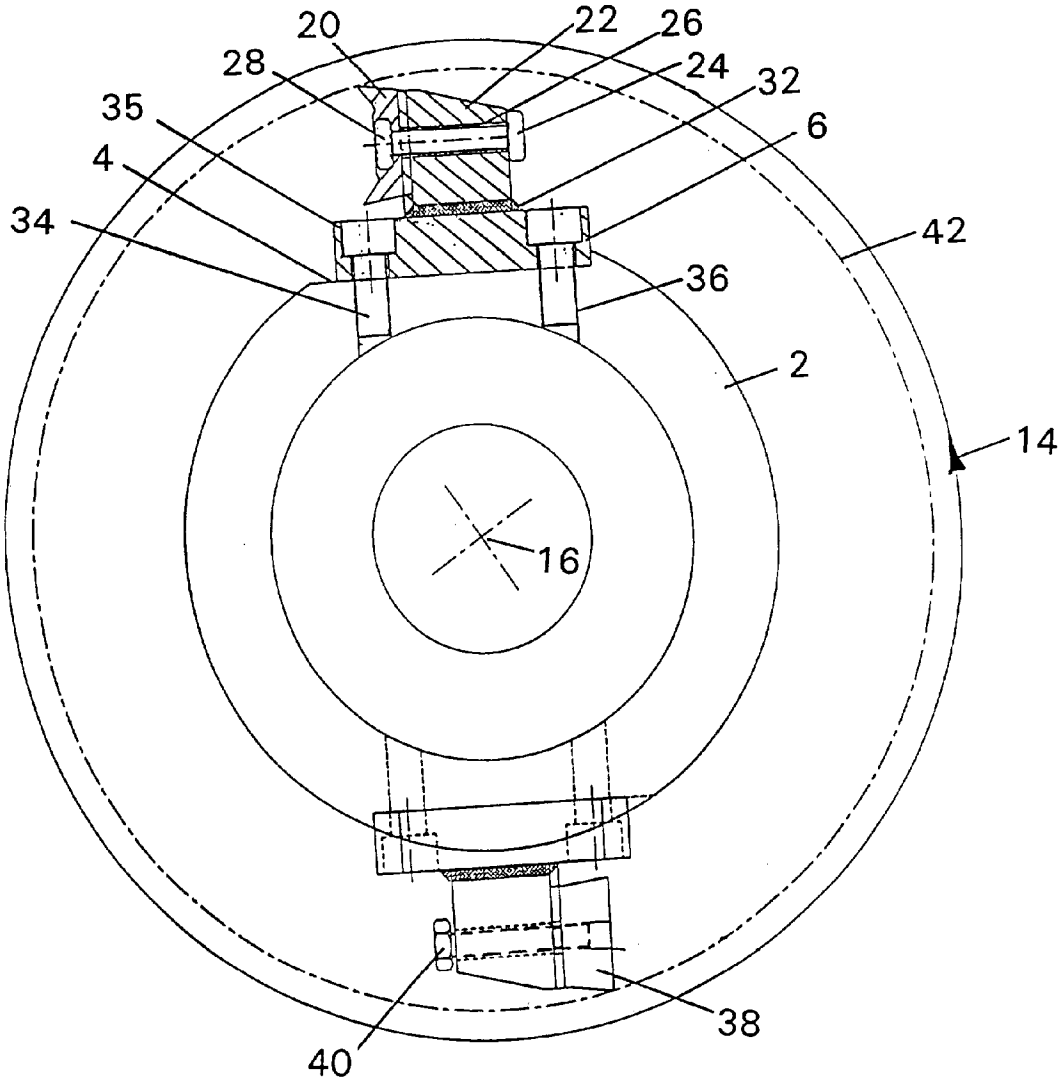
FIG. 2 is a sectional end view of a rotor of the present invention showing two types of strikers attached to the rotors by way of retainers and bases.

Referring to FIG. 2, the cruciform slot and key attachment of a striker 20 to striker retainer 22, of the present invention, is shown. The striker 20 is captively mounted to striker retainer 22 by a single bolt 28 extending through bore 26 to a nut 24 and fixed against rotation by a hex machined opening 30 in striker 20. Striker retainer 22 is captively mounted by a weld joint 32 to retainer base 6, which in turn is captively mounted to rotor 2 at retainer carrying face 4 by two bolts 34 extending through two countersunk bores 35 through retainer base 6 and mating threaded bores 36 in rotor 2.

Also shown in FIG. 2 is a second design of striker 38 which has a blind threaded hole for accepting bolt 40. The arc of striker rotation 42 is shown in FIG. 2.

Figure 3:
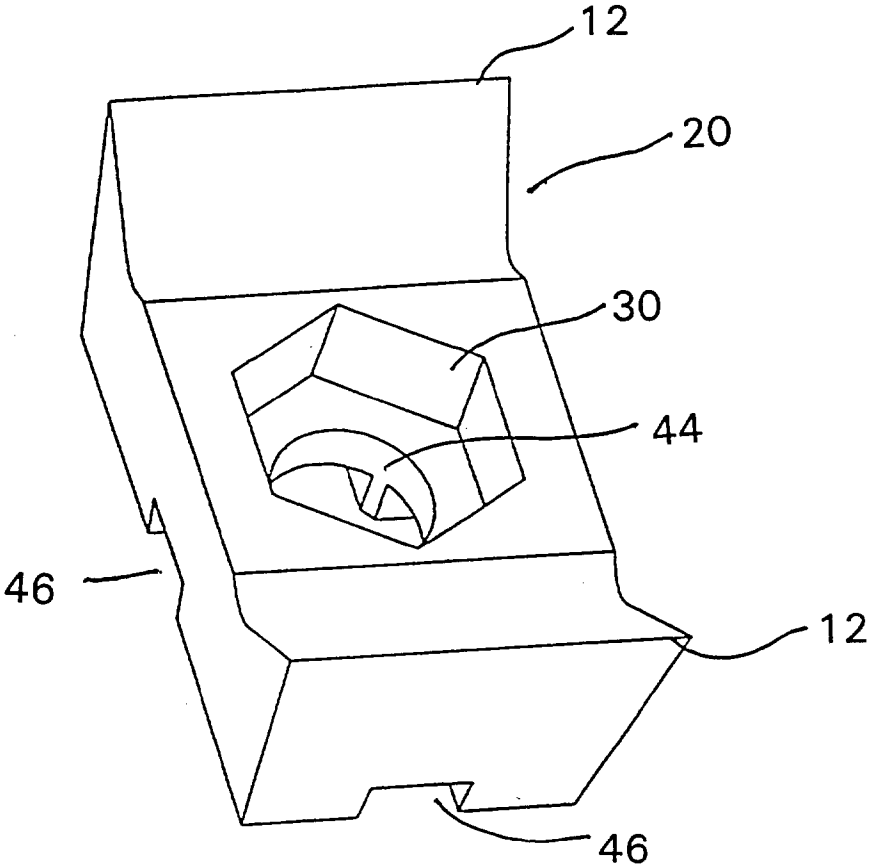
FIG. 3 is a perspective view of a preferred embodiment two edged striker with cruciform key slots, and a single fastener hex opening.
Figure 4:
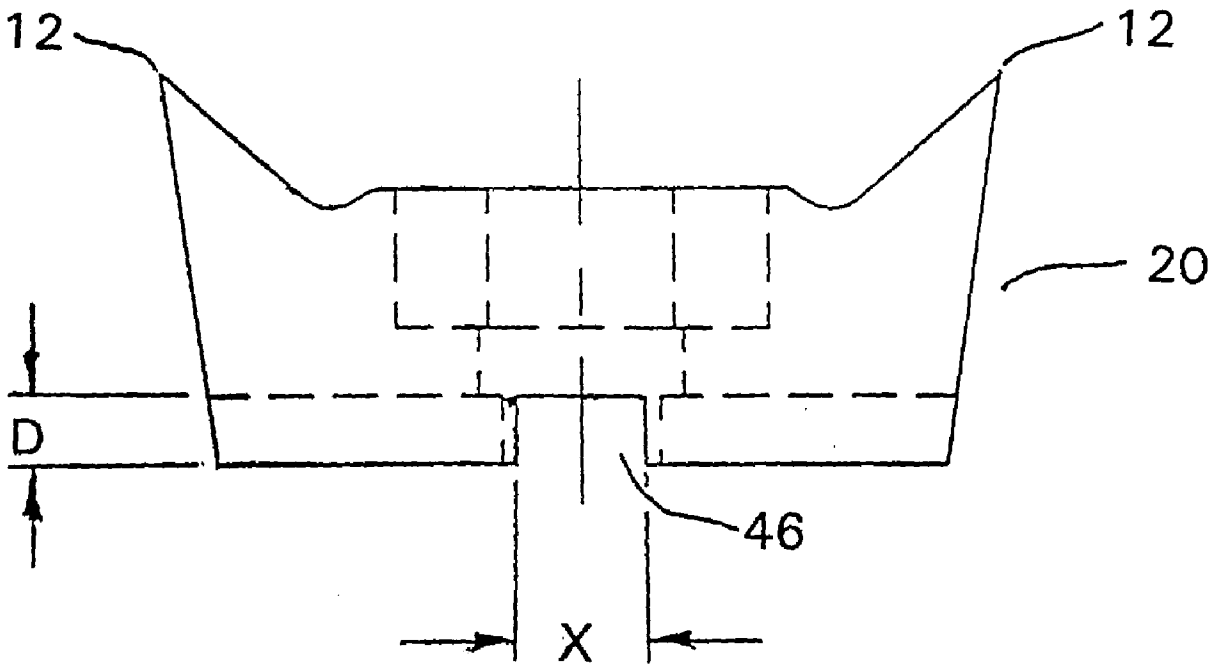
FIG. 4 is a side elevation of the striker of FIG. 2.
Figure 5:
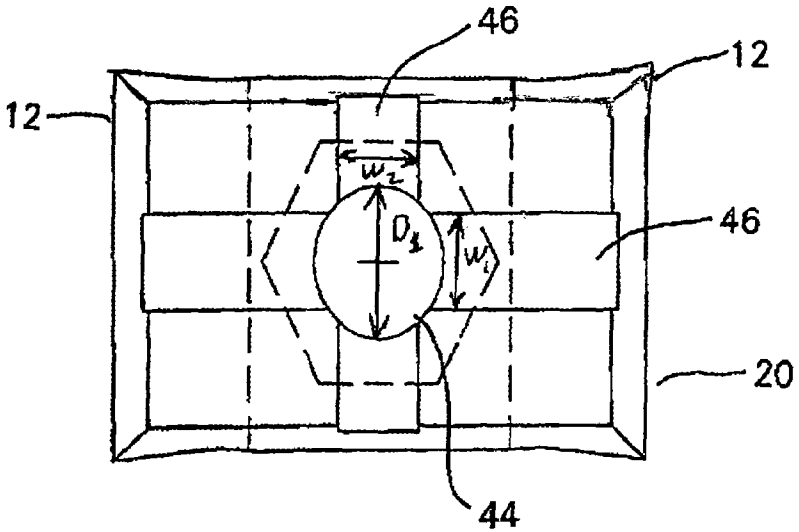
FIG. 5 is a rear view of the striker of FIG. 2 showing the cruciform key slots.

Referring to FIGS. 3, 4 and 5, preferred embodiment two edged striker 20 is shown. Cutting edges 12, hex shaped machined recessed opening 30, bolt clearance bore 44, and slots 46 are shown. Two slots 46 are machined perpendicular to each other and each centrally aligned with a centerline of clearance bore 44. The width X of slots 46 are machined to matingly receive the machined keys 50 of a striker retainer 22 (FIGS. 6 and 7), with a tight clearance fit. A tight clearance fit ensures minimal twisting motion is permitted between the striker and striker retainer. The machined depth D of slots 46 are equal to at least the height H of mating keys 50 shown in FIGS. 6 and 7 to ensure complete engagement of keys 50 within slots 46.

Figure 6:
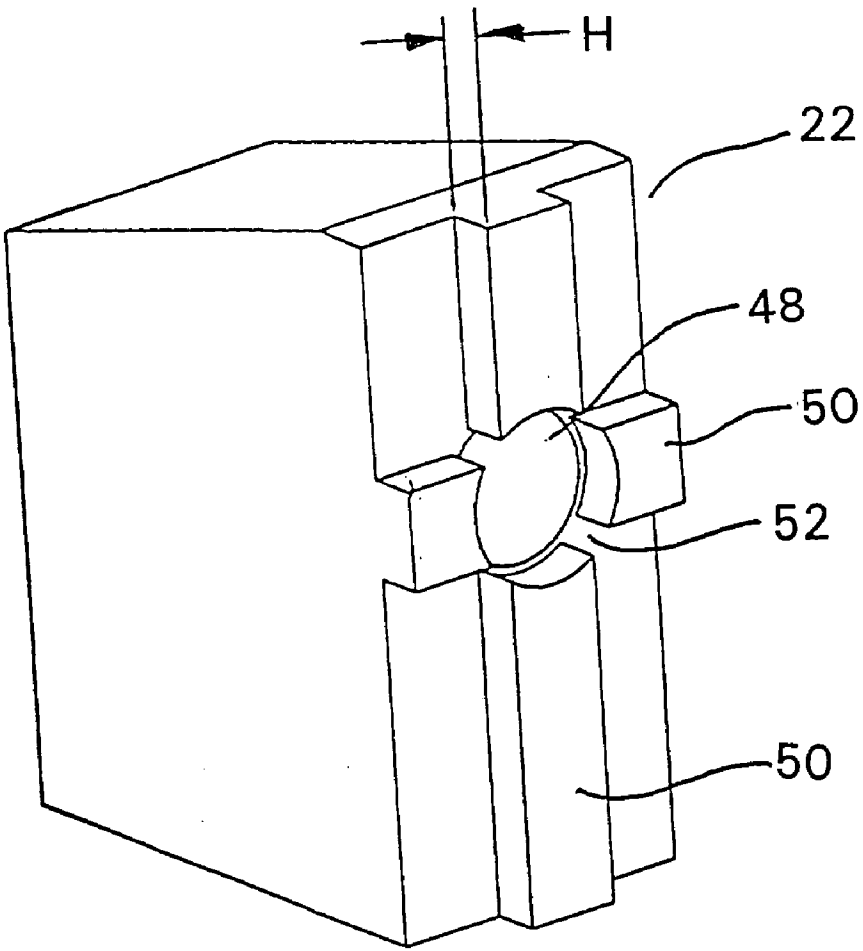
FIG. 6 is a perspective view of a striker retainer according to the present invention with male cruciform keys to engage the cruciform key slots.
Figure 7:
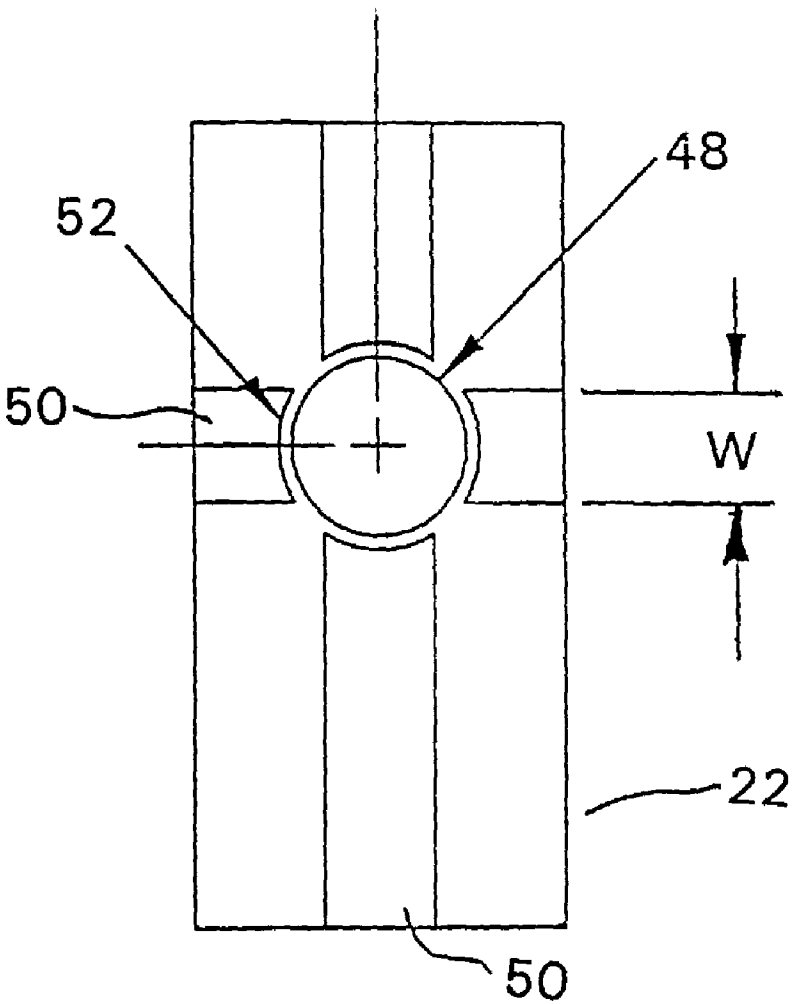
FIG. 7 is a front elevation of the striker retainer of FIG. 6.

Referring to FIGS. 6 and 7, a striker retainer 22 is shown, with the raised machined keys 50, machined to mate in a tight clearance fit with the slots 46 of striker 20. Striker retainers are shaped to have a relatively tall leading face to which the striker is attached, and a relatively short opposed following face, which allows clearance between the work piece in contact with the striker cutting edge and the shorter face, such that only the cutting edge directly contacts the work piece. A relatively larger diameter counterbore 52 than the diameter of bore 48 is machined in central alignment with bore 48 to a counterbore depth which is at least the height H of keys 50. Counterbore 52 eliminates the machining difficulty of squaring the inside corners of keys 50 where the keys 50 intersect bore 48. This ensures mating alignment between keys 50 and slots 46 for the entire height H of keys 50. Key width W is machined on striker retainer 22 for the tight clearance fit with slots 46 discussed herein. Bore 48 is shown vertically off center of striker retainer 22 in FIG. 7, to provide a desired clearance of the bore from the retainer base 6.

Figure 8:
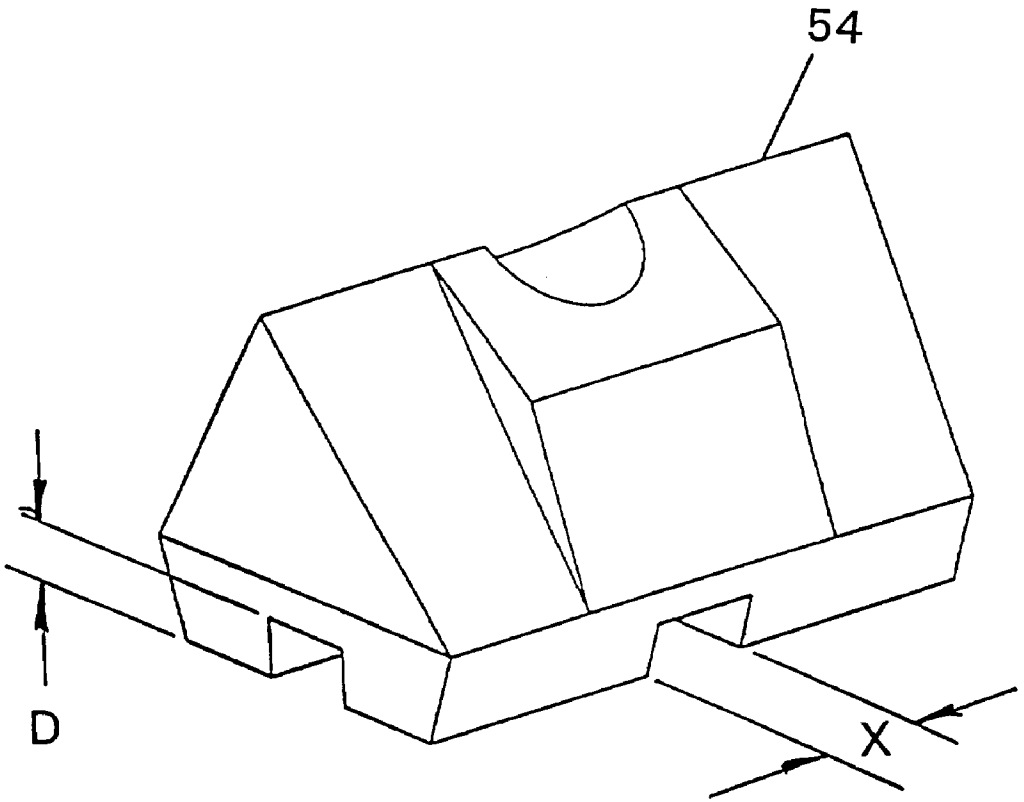
FIG. 8 is an alternative embodiment single tooth striker according to the invention.

FIG. 8 is an alternative embodiment of a striker having a cutting edge 54 rotated 90 degrees compared to cutting edges 12 of FIG. 3, and including the cruciform slots of the present invention.

In use, slots 46 in striker 20 mate with the keys of striker retainer 22 such that motion between the mating faces of striker 20 and striker retainer 22 is minimized and alignment is assured. While connecting the striker 20 to striker retainer 22, the head of a hex bolt 28 is matingly positioned in hex machined opening 30. The bolt 28 connects with nut 24. Bolt 24 extends through clearance bore 44 in striker 20 and through bore 26, to threadably engage with hex nut 24. Torquing hex nut 24 to bolt 28 mechanically fastens striker 20 and striker retainer 22.

When the first of striker 20 cutting edges 12 becomes dull through use, nut 24 is removed, striker 20 is lifted away from striker retainer 22 until the slots 46 and keys 50 no longer engage, and striker 20 is rotated 180 degrees and its slots 46 re-mated to keys 50 of striker retainer 22. Nut 24 and bolt 28 are then re-threaded and torqued to complete the reassembly. If both cutting edges 12 of striker 20 become dull from use, and resharpening or replacement of striker 20 is required, the above steps to remove and reassemble striker 20 are applied, eliminating the rotation step.

It is desirable to rotate a sharp cutting edge 12 into position by loosening, but not totally removing, nut 24 from bolt 28. This prevents loss of either or both nut 24 and bolt 28, and speeds up this maintenance evolution.

The preferred embodiment of the invention includes cruciform shaped, or two (2) perpendicular slots, mating with two (2) perpendicular raised keys. Other forms of slot and key attachment are feasible, including but not limited to a single slot and mating key, more than two slots and mating keys, and slot/key combinations machined transversely. It will be understood that the use of at least one slot and key combination provides a face to face horizontal locking means between the striker and striker retainer which enables use of a single fastener or fastening technique to be applied to positively join the faces of the striker and striker retainer of a comminuting device.

It should also be understood that the items receiving the slot and key may be reversed. In the claimed invention, the striker may therefore have a raised key or keys in place of the female slot(s), and the striker retainer may have a slot or slots in place of the male key(s). The raised keys, if more than one is employed, would then be counterbored as noted herein. Other aspects of the claimed invention would remain similar to those described herein.

Figure 9:
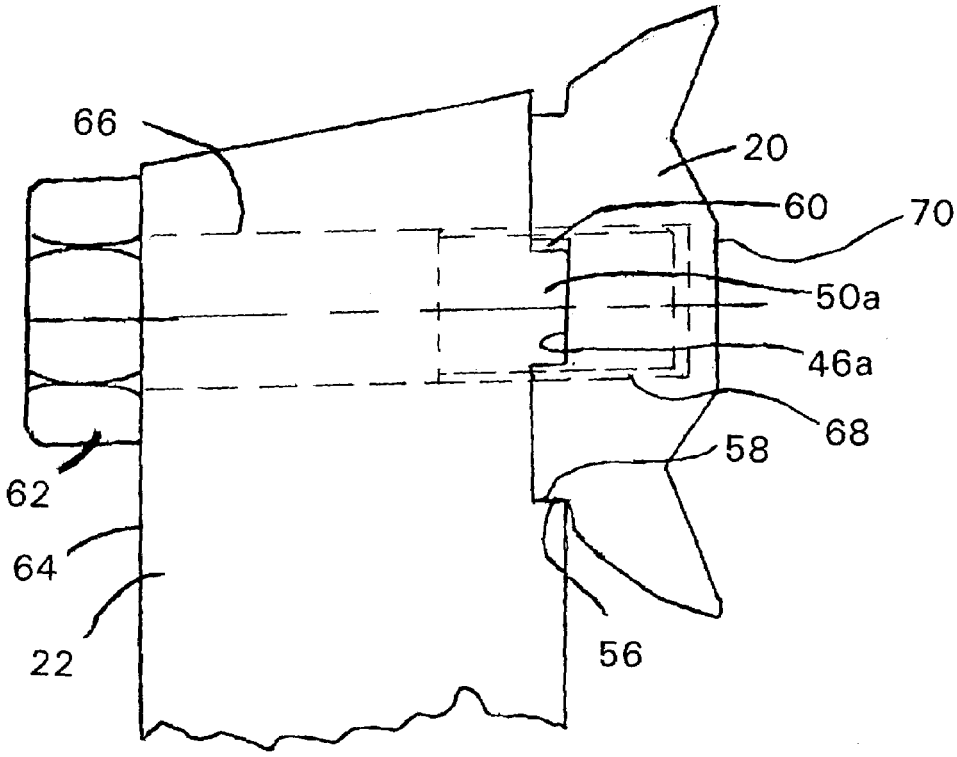
FIG. 9 is an elevation of a further embodiment of striker and striker retainer of the present invention shown assembled and bolted together.
Figure 10:
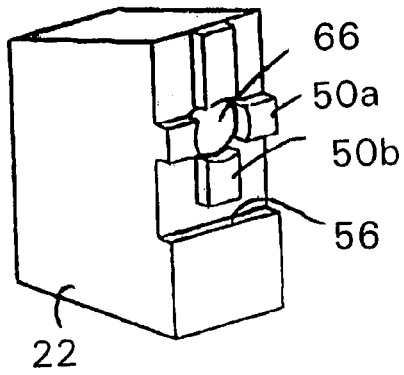
FIG. 10 is a perspective view of the striker retainer shown in FIG. 9.
Figure 11:
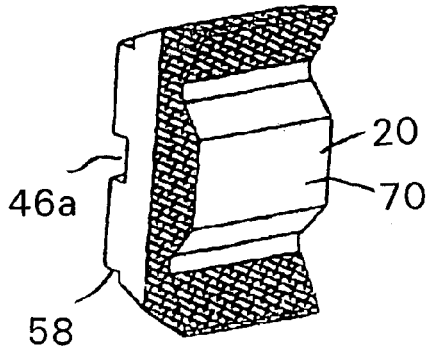
FIG. 11 is a perspective of the striker shown in FIG. 9.

Referring now to FIGS. 9, 10 and 11, an alternative embodiment of striker 20 and striker retainer 22 is shown in which, when assembled together (FIG. 9), an upward facing surface 56 on the retainer 22 provides primary support for the striker 20 by virtue of the engagement of the surface 56 with a corresponding surface 58 machined in the striker 20. This primary support is facilitated by the provision of a clearance 60 (e.g. 0.010 inch) between the machined key 50*a* of the striker retainer 22 and the corresponding slot 46*a* in the striker, this clearance 60 is between the upwardly facing surface of the key 50*a* and the downwardly facing surface of the slot 46*a* (as seen in the orientation of the assembly in FIG. 9).

The key 50*a* and slot 46*a* are designed to provide a secondary support for the striker when wear of the striker 20 sufficient to reduce the clearance 60 to zero has occurred.

To facilitate this embodiment the key 50*b* is foreshortened.

The striker 20 is attached to the striker retainer 22 by a threaded bolt 62 extending from the following face 64 of the striker retainer through a single bore 66 to attach the striker 20 to the striker retainer 22 by the use of bore 68 having a thread corresponding to the thread of the bolt 62. To prevent damage to the threaded bore 68 and the end of the bolt adjacent the first face 70 of the striker 20, the threaded bore 68 is preferably terminated to form a blind bore which does not extend to the first face 70 of the striker.

Preferably the striker 20 has carbide surfaces as shown by cross-hatching in FIG. 11.

Except as described with reference to FIGS. 9, 10 and 11 the other features of this embodiment are similar to the embodiment described with reference to FIGS. 2–7 and will therefore not be described again here.

| Reference Numerals | |
|---|---|
| 2 | rotor |
| 4 | retainer carrying face |
| 6 | retainer base |
| 8 | striker |
| 10 | striker retainer |
| 12 | striker cutting edge |
| 14 | rotor rotation |
| 16 | rotor axis |
| 18 | projection |
| 20 | modified striker |
| 22 | modified striker retainer |
| 24 | nut |
| 26 | bore |
| 28 | bolt |
| 30 | hex machined opening |
| 32 | weld joint |
| 34 | bolt |
| 35 | countersunk bore |
| 36 | threaded bore |
| 38 | alternative striker |
| 40 | bolt |
| 42 | striker arc |
| 44 | clearance bore |
| 46, 46a | slot |
| 48 | bore |
| 50, 50a, 50b | raised keys |
| 52 | counter bore |
| 54 | striker cutting edge |
| 56 | upward facing surface |
| 58 | corresponding surface |
| 60 | clearance |
| 62 | threaded bolt |
| 64 | following face |
| 66 | single bore |
| 68 | threaded bore |
| 70 | first face |
| D | slot depth |
| H | key height |
| X | slot width |
| W | key width |

I claim:

1. A reversible striker, for use with a striker retainer, which is arranged to be mounted on a comminuting apparatus and support and align the striker when the striker is attached to the striker retainer;

the striker comprising first and second opposed faces and first and second opposed end surfaces, the first face and the first and the second end surfaces defining first and second opposed cutting edges equally spaced about a threaded blind bore formed in the second face, and the second face having first and second opposed support surfaces recessed inwardly, relative to the first and second end surfaces, toward the blind bore, each of the first and the second support surfaces being positioned on the striker for engagement with a cooperating support surface of the striker retainer to facilitate usage of both cutting edges and provide primary support for the striker when the striker is attached to the striker retainer, the first and second support surfaces lying in separate planes extending substantially parallel to the cutting edges and substantially perpendicular to the second face, and an elongate structural component of the striker arranged to mate with a complimentary structural component of the striker retainer thereby to facilitate desired alignment of the striker with the striker retainer when the striker is attached to the striker retainer, the elongate structural component of the striker extending perpendicular to both of the first and the second support surfaces and being coincident with the blind bore which defines a rotational axis about which the striker is reversible, the blind bore facilitates securing the striker to the striker retainer in a reversible orientation solely via a single fastener, the blind bore being centrally located in the striker and the first and second support surfaces being equally spaced from the blind bore so that when the striker is reversed about the axis of the blind bore, one of the first and the second support surfaces will engage with the cooperating support surface of the striker retainer, and a diameter of the blind bore being larger than a transverse width dimension of the structural component; and the striker having a mid-section which is thicker than a thickness of the striker adjacent each of the first and second cutting edges.

2. The striker according to claim 1 wherein the elongate structural component comprises a first slot and a further structural component of the striker comprises a further slot, and the first slot and the further slot extend perpendicularly to one another.

3. The striker according to claim 1 wherein at least the first and the second cutting edges and a portion of the first and second end surfaces are surfaced with carbide and the carbide forms a radially outward protruding step in at least both the first end surface and the second end surface.

4. The striker according to claim 3 wherein the recesses defining the first and the second support surfaces result in a transverse dimension, adjacent the cutting edges and perpendicular to the second face, which is less than the transverse dimension perpendicular to the second face adjacent the blind bore.

5. The striker according to claim 1 wherein the first face has a first depression, extending across an entire width of the first face and toward the second face, located between a mid-section of the striker and the first cutting edge, and the first face has a second depression, extending across the entire width of the first face and toward the second face, located between the mid-section of the striker and the second cutting edge; and the first support surface is recessed relative to the second face and recessed inwardly relative to the first end surface toward the blind bore and the second support surface is recessed relative to the second face and recessed inwardly relative to the second end surface toward the blind bore.

6. The striker according to claim 1 wherein the first face has a first depression located between a mid-section of the striker and the first cutting edge and extending across an entire width of the first face toward the second face, and the first face has a second depression located between the mid-section of the striker and the second cutting edge and extending across the entire width of the first face toward the second face; and a thickness of the first depression, measured perpendicular to the second face, is less than a thickness of a belly of the striker adjacent the blind bore and measured perpendicular to the second face, and a thickness of the second depression, measured perpendicular to the second face, is less than the thickness of the belly of the striker adjacent the blind bore and measured perpendicular to the second face.

7. The striker according to claim 1 wherein the thickness of the striker in the central region is supplemented by a reinforcing bulge in the central region.

8. A reversible striker, for use with a striker retainer, which is arranged to be mounted on a comminuting apparatus and support and align the striker when the striker is attached to the striker retainer;

the striker comprising first and second opposed faces and first and second opposed end surfaces, the first face and the first and the second end surfaces defining first and second opposed cutting edges equally spaced about a threaded blind bore formed in the second face, and the second face having first and second opposed support surfaces recessed inwardly, relative to the first and second end surfaces, toward the blind bore, each of the first and the second support surfaces being positioned on the striker for engagement with a cooperating support surface of the striker retainer to facilitate usage of both cutting edges and provide primary support for the striker when the striker is attached to the striker retainer, the first and second support surfaces lying in separate planes extending substantially parallel to the cutting edges and substantially perpendicular to the second face, and an elongate structural component of the striker arranged to mate with a complimentary structural component of the striker retainer thereby to facilitate desired alignment of the striker with the striker retainer when the striker is attached to the striker retainer, the elongate structural component of the striker extending perpendicular to both of the first and the second support surfaces and being coincident with the blind bore which defines a rotational axis about which the striker is reversible, the blind bore facilitates securing the striker to the striker retainer in a reversible orientation solely via a single fastener, the blind bore being centrally located in the striker and the first and second support surfaces being equally spaced from the blind bore so that when the striker is reversed about the axis of the blind bore, one of the first and the second support surfaces will engage with the cooperating support surface of the striker retainer, and a diameter of the blind bore being larger than a transverse width dimension of the structural component; and a mid-section of the striker having a thicker transverse dimension, measured perpendicular to the second face, than a transverse dimension, measured perpendicular to the second face, adjacent each of the first and second cutting edges.

9. The striker according to claim 8 wherein the striker has a belly which has a transverse dimension, measured perpendicular to the second face, greater than a transverse dimension of the striker, measured perpendicular to the second face, adjacent each of the first and second cutting edges.

10. The striker according to claim 8 wherein the first and the second cutting edges are substantially straight edges and the elongate structural component comprises an elongate slot disposed perpendicular to the first and the second cutting edges and suitable for matingly engaging a key defined by the complimentary structural component of the striker retainer.

11. The striker according to claim 10 wherein the striker has a further slot, extending perpendicular to the elongate slot, suitable for matingly engaging a further key of the striker retainer and both the elongate slot and the further slot are coincident with the blind bore.

12. The striker according to claim 8 wherein the elongate structural component and a further structural component are both coincident with the blind bore and extend perpendicular to one another and are suitable for engaging corresponding complimentary structural components of the striker retainer.

13. The striker according to claim 8 wherein the first and the second support surfaces are recessed relative, respectively, to the first and the second end surfaces whereby the thickness of the striker adjacent the first and second end surfaces, perpendicular to the second face, is less than the thickness of the striker perpendicular to the second face in a central region adjacent the blind bore.

14. The striker according to claim 13 wherein the thickness of the striker in the central region is supplemented by a reinforcing bulge in the central region.

15. The reversible striker according to claim 8, wherein the elongate structural component comprises an elongate slot coincident with the blind bore, disposed perpendicular to the first and second cutting edges and suitable for engaging the complimentary structural component in the form of a key on the striker retainer.

16. The striker according to claim 15, wherein a further structural component of the striker comprises a further slot, extending perpendicular to the elongate slot, suitable for engaging a further key of the complimentary structural component of the striker retainer and both the elongate slot and the further slot are coincident with the blind bore.

17. The reversible striker according to claim 8, wherein the elongate structural component comprises an elongate key coincident with blind bore, disposed perpendicular to the first and second cutting edges and suitable for engaging the complimentary structural component in the form of a slot in the striker retainer.

18. The striker according to claim 17, wherein a further structural component of the striker comprises a further key, extending perpendicular to the elongate key and suitable for engaging a further slot of the complimentary structural component of the striker retainer, both the elongate key and the further key are coincident with the blind bore.

19. A reversible striker, for use with a striker retainer, which is arranged to be mounted on a comminuting apparatus and support and align the striker when the striker is attached to the striker retainer:

the striker comprising first and second opposed faces and first and second opposed end surfaces, the first face and the first and the second end surfaces defining first and second opposed cutting edges equally spaced about a threaded blind bore formed in the second face, and the second face having first and second opposed support surfaces recessed inwardly, relative to the first and second end surfaces, toward the blind bore, each of the first and the second support surfaces being positioned on the striker for engagement with a cooperation support surface of the striker retainer to facilitate usage of both cutting edges and provide primary support for the striker when the striker is attached to the striker retainer, the first and second support surfaces lying in separate planes extending substantially parallel to the cutting edges and substantially perpendicular to the second face, and an elongate structural component of the striker arranged to mate with a complimentary structural component of the striker retainer thereby to facilitate desired alignment of the striker with the striker retainer when the striker is attached to the striker retainer, the elongate structural component of the striker extending perpendicular to both of the first and the second support surfaces and being coincident with the blind bore which defines a rotational axis about which the striker is reversible, the blind bore facilitates securing the striker to the striker retainer in a reversible orientation solely via a single fastener, the blind bore being centrally located in the striker and the first and second support surfaces being equally spaced from the blind bore so that when the striker is reversed about the axis of the blind bore, one of the first and the second support surfaces will engage with the cooperation support surface of the striker retainer, and a diameter of the blind bore being larger than a transverse width dimension of the structural component; and a belly section of the striker is generally thickest, when measured perpendicular to the second face, adjacent the blind bore and generally decreases in thickness toward the first cutting edge and generally decreases in thickness toward the second cutting edge.

20. The striker according to claim 19 wherein the thickness of the striker in the central region is supplemented by a reinforcing bulge in the central region.

21. A reversible striker, for use with a striker retainer, which is arranged to be mounted on a comminuting apparatus and support and align the striker when the striker is attached to the striker retainer;

the striker comprising first and second opposed faces and first and second opposed end surfaces, the first face and the first and the second end surfaces defining first and second opposed cutting edges equally spaced about a threaded blind bore formed in the second face, and the second face having first and second opposed support surfaces recessed inwardly, relative to the first and second end surfaces, toward the blind bore, each of the first and the second support surfaces being positioned on the striker for engagement with a cooperation support surface of the striker retainer to facilitate usage of both cutting edges and provide primary support for the striker when the striker is attached to the striker retainer, the first and second support surfaces lying in separate planes extending substantially parallel to the cutting edges and substantially perpendicular to the second face, and an elongate structural component of the striker arranged to mate with a complimentary structural component of the striker retainer thereby to facilitate desired alignment of the striker with the striker retainer when the striker is attached to the striker retainer, the elongate structural component of the striker extending perpendicular to both of the first and the second support surfaces and being coincident with the blind bore which defines a rotational axis about which the striker is reversible, the blind bore facilitates securing the striker to the striker retainer in a reversible orientation solely via a single fastener, the blind bore being centrally located in the striker and the first and second support surfaces being equally spaced from the blind bore so that when the striker is reversed about the axis of the blind bore, one of the first and the second support surfaces will engage with the cooperating support surface of the striker retainer, and a diameter of the blind bore being larger than a transverse width dimension of the structural component; and a belly section of striker is thicker, when measured perpendicular to the second face, adjacent the blind bore and generally decreases in thickness toward the first and second cutting edges.

22. A reversible striker, for use with a striker retainer, which is arranged to be mounted on a comminuting apparatus and support and align the striker when the striker is attached to the striker retainer:

the striker comprising first and second opposed faces and first and second opposed end surfaces, the first face and the first and the second end surfaces defining first and second opposed cutting edges equally spaced about a threaded blind bore formed in the second face, and the second face having first and second opposed support surfaces recessed inwardly, relative to the first and second end surfaces, toward the blind bore, each of the first and the second support surfaces being positioned on the striker for engagement with a cooperating support surface of the striker retainer to facilitate usage of both cutting edges and provide primary support for the striker when the striker is attached to the striker retainer, the first and second support surfaces lying in separate planes extending substantially parallel to the cutting edges and substantially perpendicular to the second face, and an elongate structural component of the striker arranged to mate with a complimentary structural component of the striker retainer thereby to facilitate desired alignment of the striker with the striker retainer when the striker is attached to the striker retainer, the elongate structural component of the striker extending perpendicular to both of the first and the second support surfaces and being coincident with the blind bore which defines a rotational axis about which the striker is reversible, the blind bore facilitates securing the striker to the striker retainer in a reversible orientation solely via a single fastener, the blind bore being centrally located in the striker and the first and second support surfaces being equally spaced from the blind bore so that when the striker is reversed about the axis of the blind bore, one of the first and the second support surfaces will engage with the cooperating support surface of the striker retainer, and a diameter of the blind bore being larger than a transverse width dimension of the structural component; and the first face has a first depression, extending across an entire width of the first face, located between a mid-section of the striker and the first cutting edge, and the first face has a second depression, extending across the entire width of the first face, located between the mid-section of the striker and the second cutting edge.

23. The striker according to claim 22 wherein the thickness of the striker in the central region is supplemented by a reinforcing bulge in the central region.

* * * * *